United States Patent [19]

Lang

[11] Patent Number: 5,076,580

[45] Date of Patent: Dec. 31, 1991

[54] FOOT POSITION TEACHING APPARATUS FOR BATTING PRACTICE

[76] Inventor: Johnny D. Lang, 3071 Date St., Jacksonville, Fla. 32218

[21] Appl. No.: 674,103

[22] Filed: Mar. 25, 1991

[51] Int. Cl.[5] ..... A63B 69/40

[52] U.S. Cl. ..... 273/26 R; 273/187 R

[58] Field of Search ..... 273/26 R, 29 A, 188 R, 273/188 A, 187 R, 187 A, 187 B

[56] References Cited

U.S. PATENT DOCUMENTS

| | | | |
|---|---|---|---|
| 3,300,219 | 1/1967 | Sipos | 273/187 R |
| 3,342,487 | 9/1967 | David . | |
| 3,384,377 | 5/1968 | Stipp | 273/187 R |
| 3,638,950 | 2/1972 | Hoytaline | 273/187 R |
| 3,658,344 | 4/1972 | Kimble | 273/187 R |
| 3,815,906 | 6/1974 | Hermo . | |
| 4,194,735 | 3/1980 | Wilson . | |
| 4,516,772 | 5/1985 | Stratton . | |
| 4,563,010 | 1/1986 | McDorman | 273/187 R |
| 4,664,375 | 5/1987 | Tetreault | 273/26 R |
| 4,796,885 | 4/1989 | Wright | 273/26 R |

FOREIGN PATENT DOCUMENTS

| | | | |
|---|---|---|---|
| 2156227 | 10/1985 | United Kingdom | 273/187 R |

*Primary Examiner*—Theatrice Brown

*Attorney, Agent, or Firm*—Henderson & Sturm

[57] ABSTRACT

A foot positioning apparatus which is flat, flexible, and easy for anyone to use. A first member and a second member are telescopically attached to each other and the first member is pivotally attached to home plate. A third member is pivotally attached to the second member and the second member has foot alignment devices on each end thereof which are also pivotally attached to the third member whereby the entire device can be adjustably pivoted around home plate to accommodate both a left hand or a right hand batter and the batter can be adjusted additionally as to foot and leg positions and distance from home plate.

3 Claims, 3 Drawing Sheets

FOOT POSITION TEACHING APPARATUS FOR BATTING PRACTICE

TECHNICAL FIELD

The present invention relates to an apparatus for teaching proper foot positioning for batting practice in ball games of a type having a ball which is disposed over home plate and hit with a bat while the bat is so disposed over home plate, and more particularly to such an apparatus which includes a flexible, flat, lightweight, portable, adjustable, foot positioner which is easy to use and economical to produce.

BACKGROUND ART

In Tee Ball, unlike baseball, the ball is hit from a tubular member extending up from home plate. It is played with almost the same rules as baseball and one of the most fundamental parts of the game is hitting the ball. In hitting the ball off the Tee, it is very important to position the batter correctly in the batter's box. One of the most important elements of proper positioning is the distance the batter is from the Tee. Another important element is the positioning of the feet with respect to the ball and to home plate.

Tee Ball players are typically from 6 to 8 years old, both boys and girls on the same teams. Children at this age level are very difficult to teach just how to position their feet and bodies when batting. They can be positioned correctly, but as soon as they moved, they quickly forget how they were before they move their feet. Consequently, there is a need for a foot positioner which will properly position the batter and furthermore remind the batter of such proper foot position, even after they have moved from such proper position.

David U.S. Pat. Nos. 3,342,487, Hermo U.S. Pat. No. 3,815,906, Wilson U.S. Pat. No. 4,194,735, and Stratton U.S. Pat. No. 4,516,772 all have teaching devices for teaching proper foot position for baseball or softball. One of the problems with these prior art devices is that they have parts sticking up or surrounding the legs and feet for players to trip over. Also, these devices are heavy and cumbersome to use.

Consequently, there is a need for batting practice and teaching devices which overcome the aforementioned shortcomings of the prior art.

DISCLOSURE OF THE INVENTION

The present invention relates to a foot positioning apparatus which is flat, flexible, and easy for anyone to use. A first member and a second member are telescopically attached to each other and the first member is pivotally attached to home plate. A third member is pivotally attached to the second member and the second member has foot alignment devices on each end thereof which are also pivotally attached to the third member whereby the entire device can be adjustably pivoted around home plate to accommodate both a left hand or a right hand batter and the batter can be adjusted additionally as to foot and leg positions and distance from home plate.

An object of the present invention is to provide an improved apparatus for teaching proper foot positioning for batting practice.

A further object of the present invention is to provide an apparatus of the aforementioned type which is flat and flexible and will conform to any irregularities in the ground thereunder.

A further object of the present invention is to provide an apparatus of the aforementioned type which has numerous adjustments so that it will easily accommodate batter of any size or shape and will allow for easy changes in batting stance and location.

A still further object of the present invention is to provide an apparatus of the aforementioned type which is extremely light and portable.

A still further object of the present invention is to provide a batting practice trainer that is durable enough to take abuse and still be economical to manufacture and be attractive in appearance.

Other objects, advantages, and novel features of the present invention will become apparent from the following detailed description of the invention when considered in conjunction with the accompanying drawings.

BEST MODES FOR CARRYING OUT THE INVENTION

Figure 1:
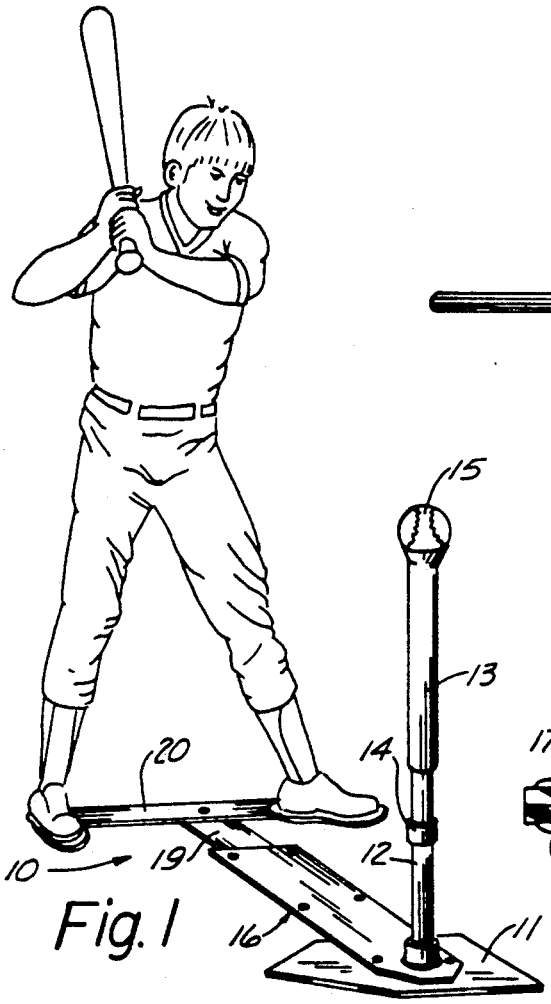
FIG. 1 is a perspective view of a preferred embodiment of the present invention shown in use with a Tee Ball home plate and ball holding device.
Figure 3:
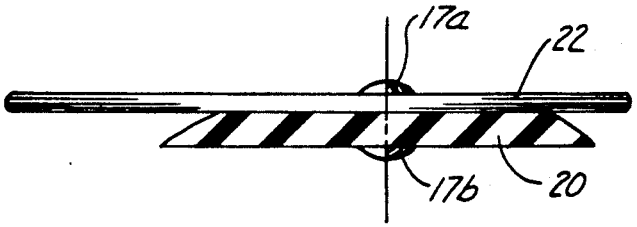
FIG. 3 is an enlarged cross sectional view taken along line 3—3 of FIG. 3.
Figure 4:
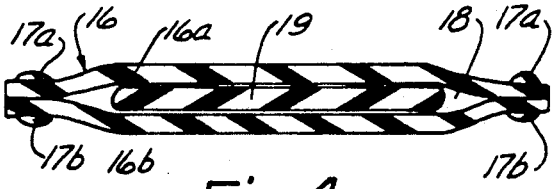
FIG. 4 is an enlarged cross sectional view taken along line 4—4 of FIG. 2.

Referring now to the drawings wherein like reference numerals designate identical or corresponding parts throughout the several views, FIG. 1 shows an apparatus (10) constructed in accordance with the present invention. A typical Tee Ball apparatus is used in conjunction with the apparatus (10) and this Tee Ball apparatus includes a home plate (11) having an upstanding post (12) with another tube (13) telescopically disposed thereover and a set screw arrangement (14) for adjusting level of the top of the post (13) having a ball (15) thereon.

A first composite member (16) includes a top portion (16*a*) fastened to a bottom portion (16*b*) by rivets (17*a*) and (17*b*). The composite member (16) includes a pocket (18) between members (16*a*) and (16*b*) for receiving a second member (19).

A third member (20) is pivotally attached to one end of the second member (19) by rivets (17*a*) and (17*b*) so that the member (20) can pivot with respect to the second member (19). Additionally, foot alignment members (21) and (22) are also pivotally attached by rivets (17*a*) and (17*b*) to the ends of the third member (20).

Figure 2:
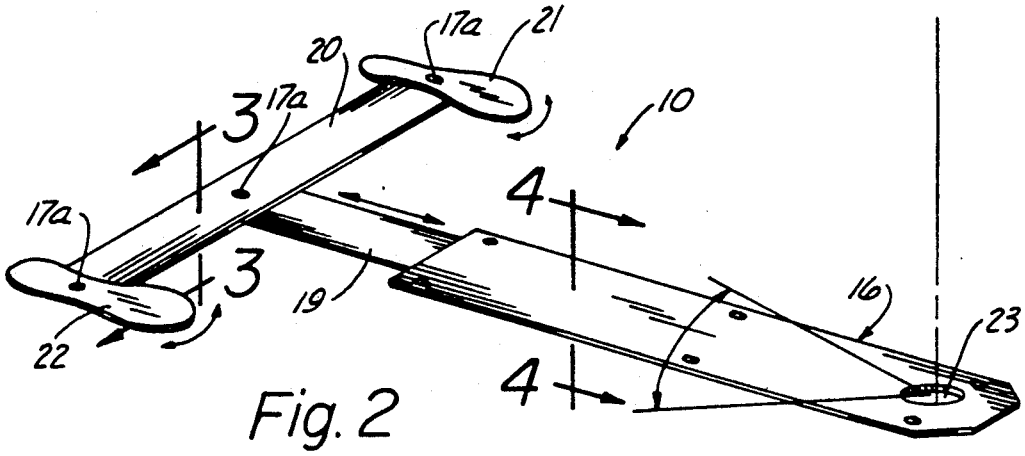
FIG. 2 is a perspective view of a preferred embodiment of the present invention shown without being attached to a Tee Ball apparatus.
Figure 5:
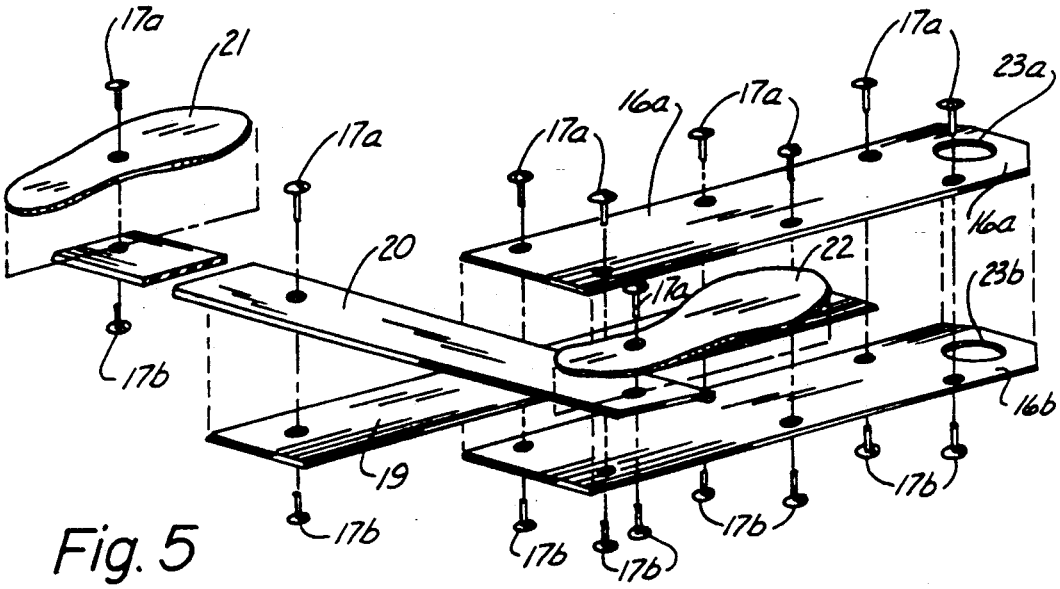
FIG. 5 is an exploded perspective view of the preferred embodiment shown in FIGS. 1 and 2.

To use the apparatus (10) shown in FIG. 2, it would first be placed over the top of the Tee Ball tubes (12) and (13) wherein the hole (23) in composite member (16) is disposed in the position shown in FIG. 1 whereby composite member (16) and consequently all of apparatus (10) can be pivoted about a vertical axis which would extend through the tubes (12) and (13).

Figure 6:
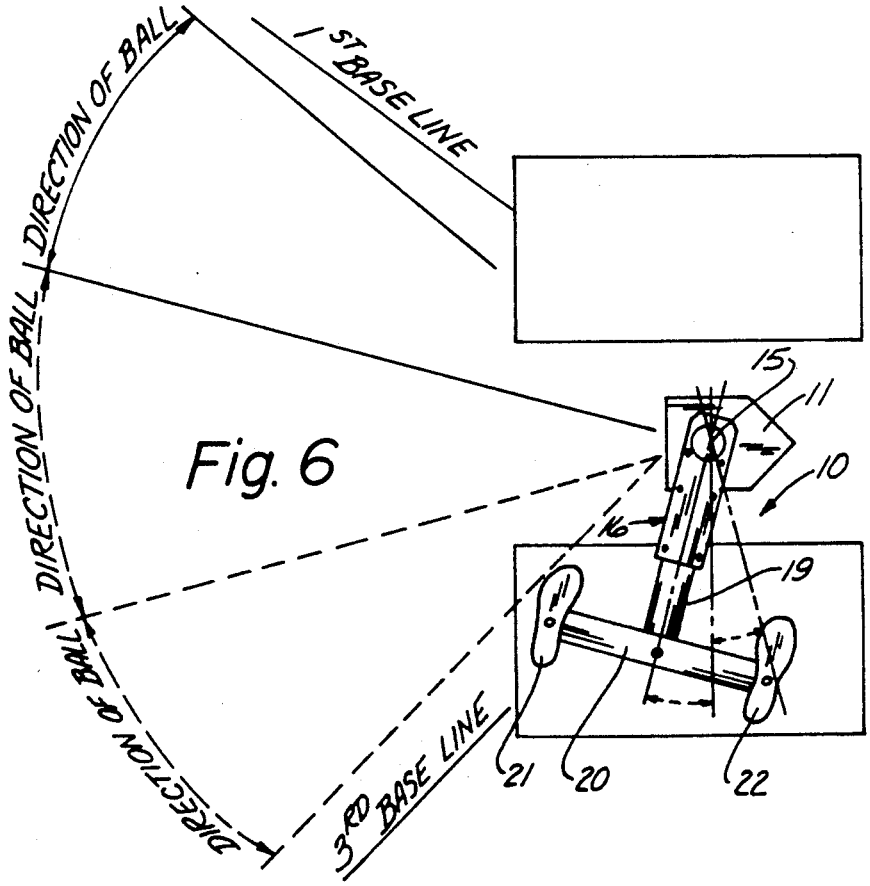
FIG. 6 is a top plan view of the present invention shown in position for a right hand batter and showing home plate and the batter's boxes for both left and right hand batters as well as the likely direction of a ball being hit as a function of the position of the batter's feet in the batter's box.

Referring to FIG. 6, it is noted how the stance can be changed by the adjustment of merely pivoting the apparatus (10) about this vertical axis through home plate (11). The solid line of direction of the ball in FIG. 6 shows the likely direction of the ball when the user is positioned in the position of the apparatus (10) shown in FIG. 6. If it is desired for the right handed batter to hit more toward left field, then the apparatus (10) would be pivoted about the vertical axis to one of the dashed line positions shown in FIG. 6. Another adjustment that can be made is to turn the foot alignment members (21) and (22) to one side or the other. Additionally, the second member (20) can be pivoted with respect to the first and second members (16) and (19) if it is not desired to maintain the perpendicular relationship shown in FIG. 6.

Another important aspect of the present invention is the telescoping nature of first and second member (16) and (19). By adjusting these members inwardly or outwardly, the batter can be positioned closer to or farther from the ball (15).

It is also important to note that the composite members (16), second and third members (19) and (20) and foot positioner members (21) and (22) are all preferably made of a flexible material such as rubber or plastic, such as polyvinyl chloride. By having the structure of apparatus (10) flat and flexible, it will conform to the irregularities of the ground therearound and consequently will be safe and not interfere with the game itself.

Figure 7:
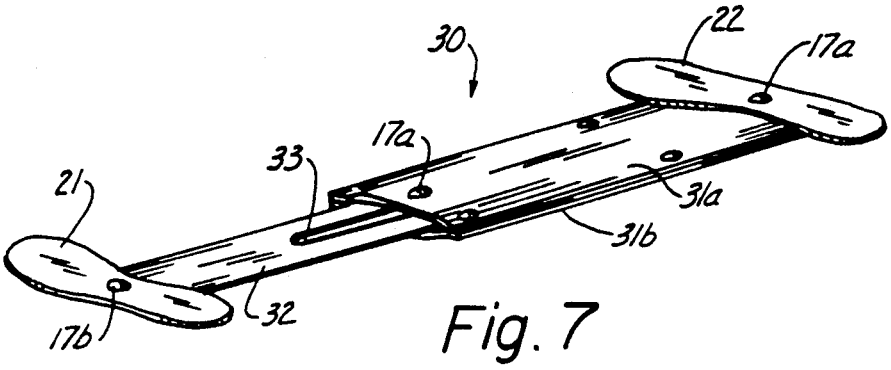
FIG. 7 is a perspective view of an alternate embodiment of the present invention.
Figure 8:
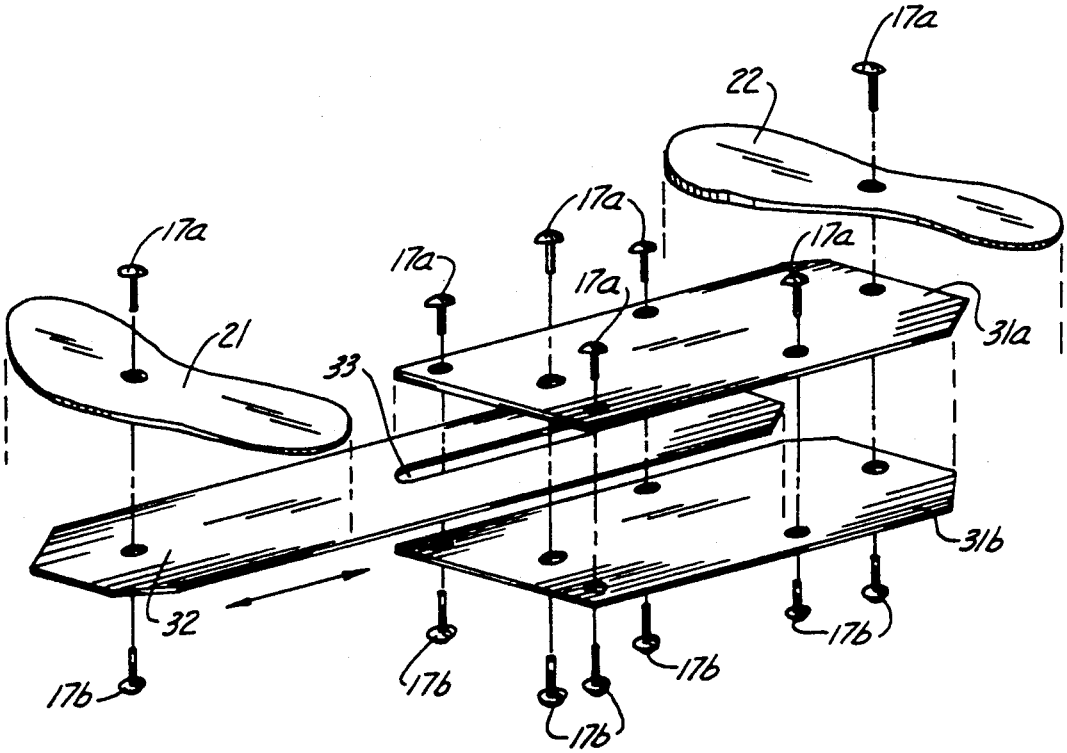
FIG. 8 is an enlarged exploded view of the embodiment shown in FIG. 7.

Referring now to the embodiment (30) of FIGS. 7 and 8, it is noted that a housing is comprised of members (31*a*), (31*b*) and (32). This housing can telescope like composite member (16) and second member (33) is disposed in member (32) and rivets (17*a*) and (17*b*) extend through members (31*a*), (31*b*) and through the slot (33) to form a limit stop for limiting the amount of telescoping of the housing. Foot alignment members (21) and (22) are pivotally attached to the ends of the housing as shown in FIGS. 7 and 8, just like they are attached to the apparatus (10) of FIGS. 1–6.

To utilize the apparatus (30) shown in FIGS. 7 and 8, the user needs to merely lay it on the ground at the proper position with respect to home plate (11). This allows for essentially an infinite amount of adjustment since it can be laid in almost any position. The distance between the foot adjustment members (21) and (22) can be easily adjusted by telescoping the housing in or out and the foot alignment members (21) and (22) can, of course, be turned however desired. The apparatus (30) is of course preferably constructed of flat and flexible rubber or plastic just like apparatus (10).

Obviously, many modifications and variations of the present invention are possible in light of the above teachings. It is therefore to be understood that, within the scope of the appended claims, the invention may be practiced otherwise than as specifically described.

I claim:

1. An apparatus for teaching proper foot positioning for baseball batting practice comprising:

a planar member representing a conventional baseball home plate, an elongated housing having first and second ends, said home plate being pivotally attached to said housing first end;

an elongated telescoping member having first and second ends, said telescoping member having its first end telescoping and adjustably extending into said second end of said housing, an elongated foot positioning means pivotally attached to an transversely of said telescoping member at the second end thereof, said foot positioning means having spaced apart receiving means pivoted at each end thereof for receiving the right and left foot of a batter facing said home plate;

an elongated ball support tee attached to said first end of said housing and said home plate and extending vertically upward therefrom; and said housing, said foot positioning means, said foot receiving means and said telescoping member being flexible to conform substantially to a support surface.

2. The apparatus as defined in claim 1, wherein, each of said foot receiving means is in the shape of the sole of a shoe.

3. The apparatus as defined in claim 1, wherein, said home plate has a central opening, said opening receiving the lower end of said ball support tee, the upper end of said tee having ball receiving for stationarily holding a ball placed thereon.

* * * * *